US008794249B2

(12) United States Patent
Gerber et al.

(10) Patent No.: US 8,794,249 B2
(45) Date of Patent: Aug. 5, 2014

(54) CARTRIDGE TYPE SHAVING BRUSH

(76) Inventors: Sherwin H. Gerber, Buffalo Grove, IL (US); Lawrence Wurtz, Arlington Heights, IL (US)

( * ) Notice: Subject to any disclaimer, the term of this patent is extended or adjusted under 35 U.S.C. 154(b) by 0 days.

(21) Appl. No.: 13/455,710

(22) Filed: Apr. 25, 2012

(65) Prior Publication Data

US 2013/0118515 A1 May 16, 2013

Related U.S. Application Data

(60) Provisional application No. 61/559,427, filed on Nov. 14, 2011.

(51) Int. Cl.
*A45D 27/16* (2006.01)

(52) U.S. Cl.
USPC ..... 132/290

(58) Field of Classification Search
USPC ..... 132/289, 290, 313, 317, 318, 112, 116, 132/120, 148; 401/190, 270
See application file for complete search history.

(56) References Cited

U.S. PATENT DOCUMENTS

| | | | | |
|---|---|---|---|---|
| 1,407,230 | A * | 2/1922 | Spielberger | 132/114 |
| 1,591,678 | A * | 7/1926 | Garris | 222/320 |
| 2,358,252 | A * | 9/1944 | Peyton | 132/290 |
| 3,231,923 | A * | 2/1966 | Gaines | 401/190 |
| 3,388,958 | A * | 6/1968 | Johnson | 401/2 |
| 3,426,769 | A * | 2/1969 | Slewing | 132/290 |

* cited by examiner

*Primary Examiner* — Rachel Steitz
(74) *Attorney, Agent, or Firm* — Cardinal Law Group

(57) ABSTRACT

Embodiments of the invention relate to a shaving brush including a housing having opposing first and second ends; a least one bristle located at the first end; and a replacable element located in the housing in fluid communication with the brush.

12 Claims, 7 Drawing Sheets

CARTRIDGE TYPE SHAVING BRUSH

CLAIM FOR PRIORITY

This application is related to, and claims priority from Provisional Application No. 61/559,427 filed Nov. 14, 2011, the complete subject matter of which is incorporated herein by reference.

FIELD OF THE INVENTION

The invention relates to a shaving brush. More particularly, the invention relates to a shaving brush system and method including a replaceable element and/or cartridge.

BACKGROUND OF THE INVENTION

Shaving cans are large and bulky, especially when traveling. One alternative is to use a tube containing shaving cream or travel size shaving cans. However, these containers leak and are unheated, resulting in a less satisfactory shave.

For the foregoing reasons, there is a need for a shaving brush that is manageable in size, easy to use and may be heated.

SUMMARY OF THE INVENTION

Embodiments of the invention relate to a shaving brush includes a housing having opposing first and second ends; a least one bristle located at the first end; and a replacable element located in the housing in fluid communication with the at least one bristle.

Other embodiments relate to a shaving brush includes a housing having opposing first and second ends; a plurality of bristles located at the first end; a replaceable cap located at the second end; a replacable element located in the housing communicating with the replaceable cap and in fluid communication with the plurality of bristles; and an engagement mechanism communicating with at least the replaceable element, whereby engaging the engagement mechanism dispenses a cream into the plurality of bristles.

Still other embodiments relate to a method of shaving using a shaving brush, the shaving brush having a housing with opposing first and second ends; a plurality of bristles located at the first end; a replaceable cap located at the second end; at least one engagement mechanism located on at least one of the housing, in the housing and the replaceable cap; and a replacable element located in the housing communicating with the at least one engagement mechanism and in fluid communication with the plurality of bristles. The method of shaving includes engaging the at least one engagement mechanism; dispensing a cream into the plurality of bristles; spreading the cream over at least a portion of a user's face; and shaving using a razor.

The foregoing and other features and advantages of the invention will become further apparent from the following detailed description of the presently preferred embodiment, read in conjunction with the accompanying drawings. The drawings are not to scale. The detailed description and drawings are merely illustrative of the invention rather than limiting, the scope of the invention being defined by the appended claims and equivalents thereof.

BRIEF DESCRIPTION OF THE DRAWINGS

Throughout the various figures, like reference numbers refer to like elements.

DETAILED DESCRIPTION OF PRESENTLY PREFERRED EMBODIMENTS

One embodiment relates to a shaving brush with an integrated dispenser for dispensing shaving cream in a solid or semi-solid form including foam, gel, soap, lotion, stick, liquid, other substances or combinations thereof that provide lubrication and protection during the shaving process, hereinafter referred to as cream. The device comprises a brush assembly and an integrated dispenser. The dispenser maybe integrated with the brush assembly to form a device, having a cartridge or canister containing cream is inserted into the device, where the brush is removed from the cartridge or canister and attached to a new cartridge or canister. The cartridge maybe pressurized or non-pressurized. The device may also allow for the warming of the cream before application to the face or other parts of the body.

Figure 1:
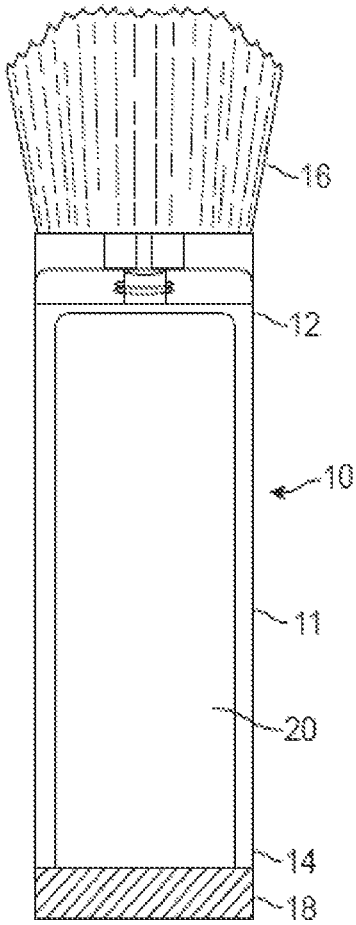
FIG. 1 is a partial cross-sectional view of the shaving brush in accordance with one embodiment of the present invention.
Figure 2:
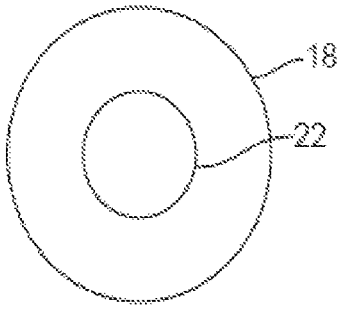
FIG. 2 is an end view of the shaving brush of FIG. 1 in accordance with one embodiment of the present invention.
Figure 3:
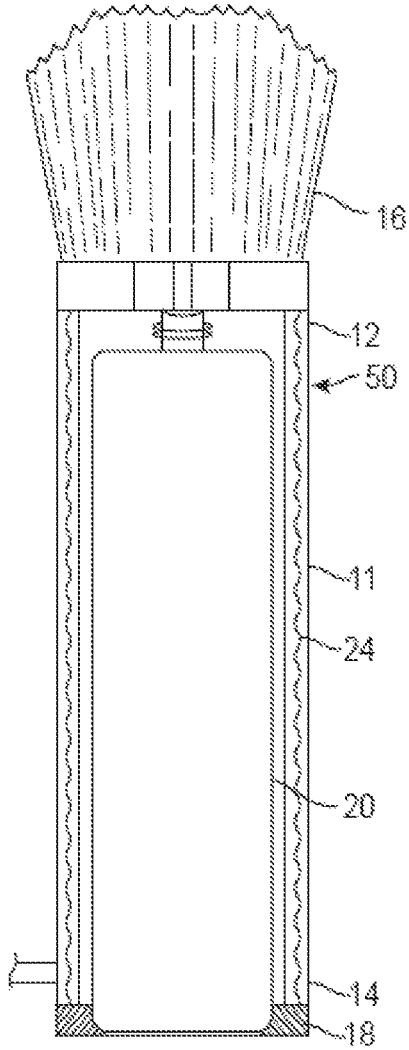
FIG. 3 a partial cross-sectional view of a shaving brush in accordance with another embodiment of the present invention.

FIGS. 1-2 depict a device 10 consisting of a housing 11 with a brush assembly 16 having at least one or more bristles at one end 12 of the housing 11 and a detachable bottom 18 at the other end 14 that can be removed to insert a canister or cartridge 20. Mechanisms communicating with the device 10 engage the pressurized cartridge or canister 20, dispensing the cream into the bristles for example. The dispensing mechanism may comprise a push button 22 in the bottom 18 of the device 10, a spring and plate or another such mechanism (best viewed in FIGS. 1-2). The device 10 may further include a one way seal that prevents the cream from leaking into the housing 11. The cream is then discharged from the cartridge or container through the base of the brush assembly 16 and into one or more bristles for application to a part of the body. The pressurized cartridge would dispense the cream through the use of pressure forcing the cream up and out the base of the brush assembly into one or more bristles for application of the cream to a part of the body. Another embodiment of the device 50, similar to that of device 10, is illustrated in FIG. 3. As illustrated, device 50 may include a heating coil or element 24 powered by a battery or other portable power source.

Figure 4:
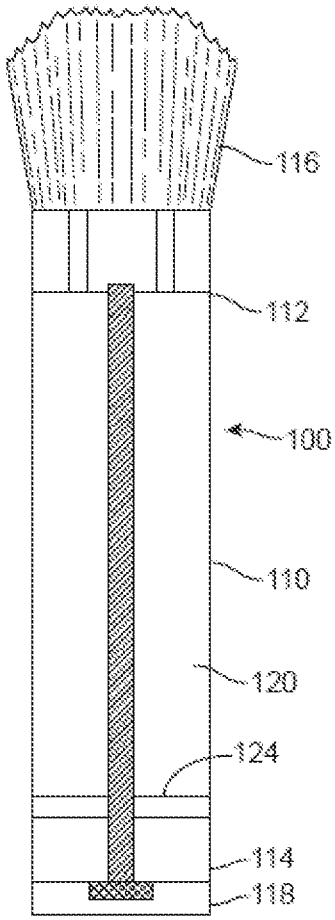
FIG. 4 a partial cross-sectional view of a shaving brush in accordance with yet another embodiment of the present invention.
Figure 8:
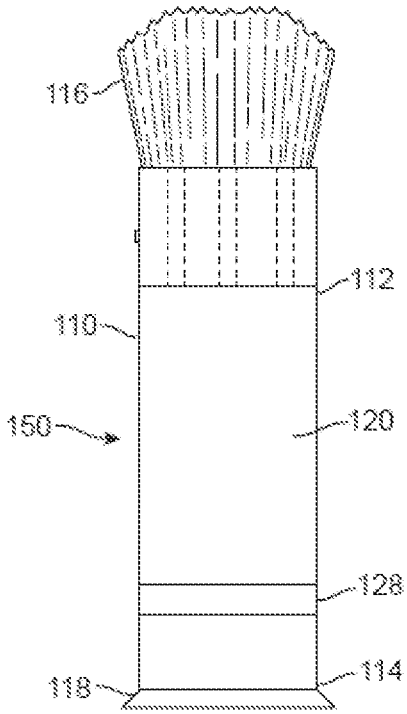
FIG. 8 is a partial transparent view of the shaving brush in accordance with yet another embodiment of the present invention.
Figure 5:
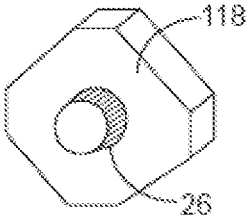
FIG. 5 is an end view of the shaving brush in accordance with one embodiment of the present invention.
Figure 9:
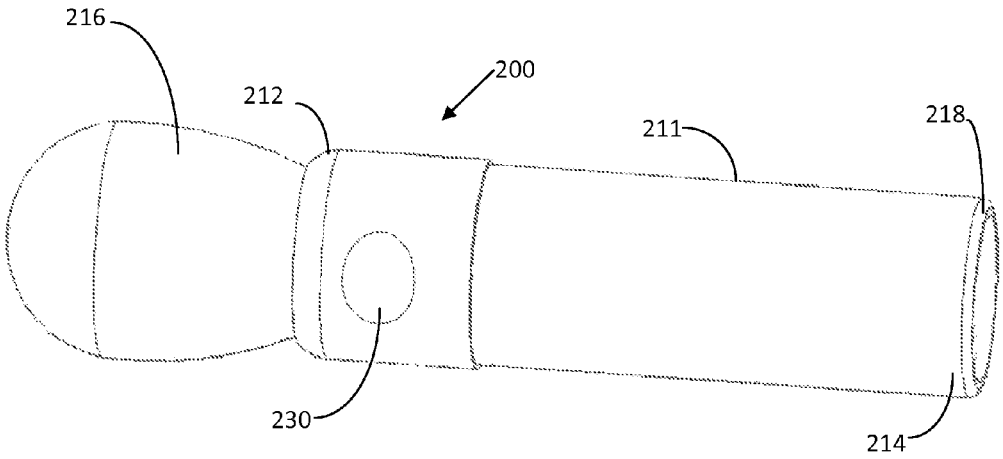
FIG. 9 is a view of a shaving brush in accordance with still another embodiment of the present invention.
Figure 10:
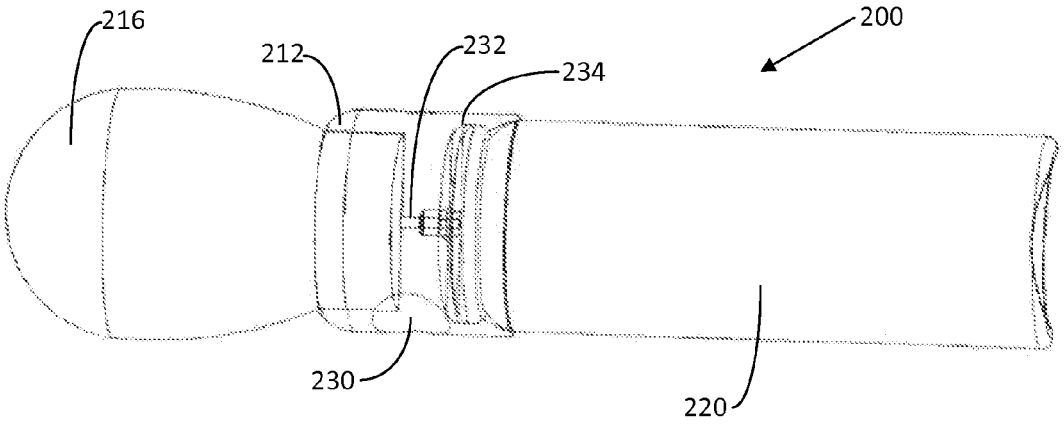
FIG. 10 is a partially transparent view of the shaving brush of FIG. 9 in accordance with one embodiment of the present invention.
Figure 11:
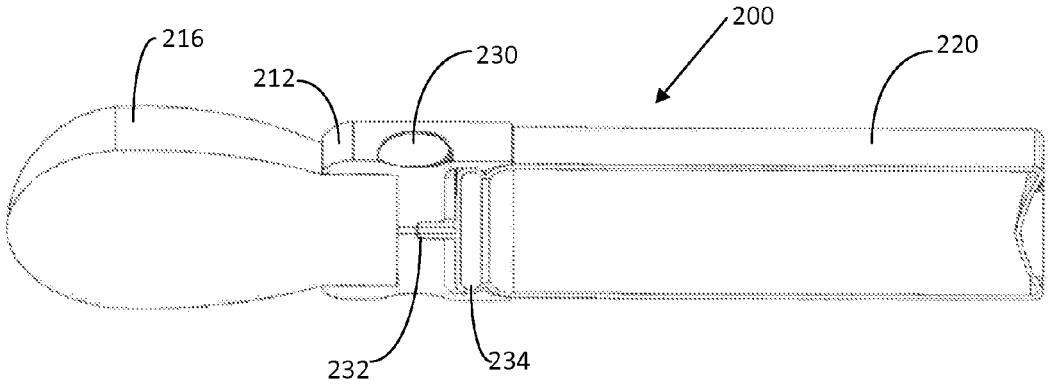
FIG. 11 is a cross-sectional view of the shaving brush of FIG. 9 in accordance with one embodiment of the present invention.
Figure 12:
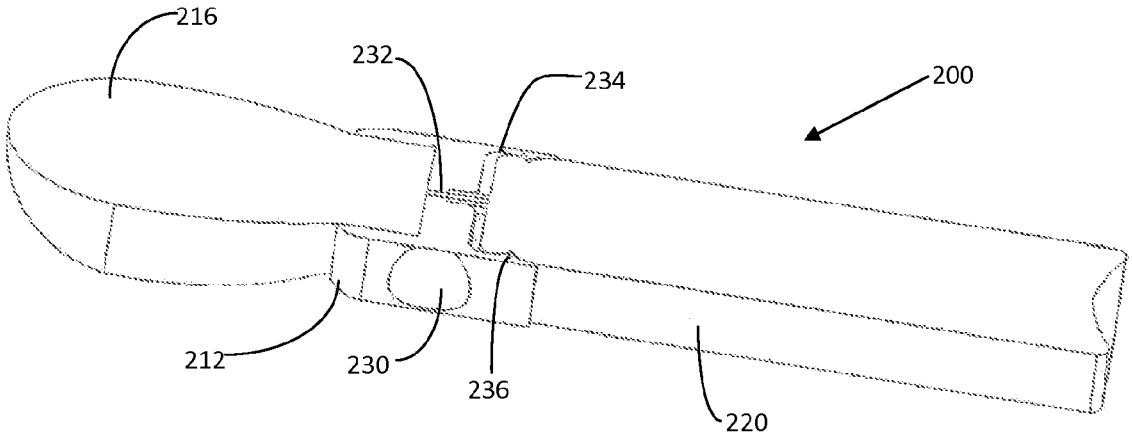
FIG. 12 is a cross-section view of the shaving brush of FIG. 9 in accordance with one embodiment of the present invention.
Figure 13:
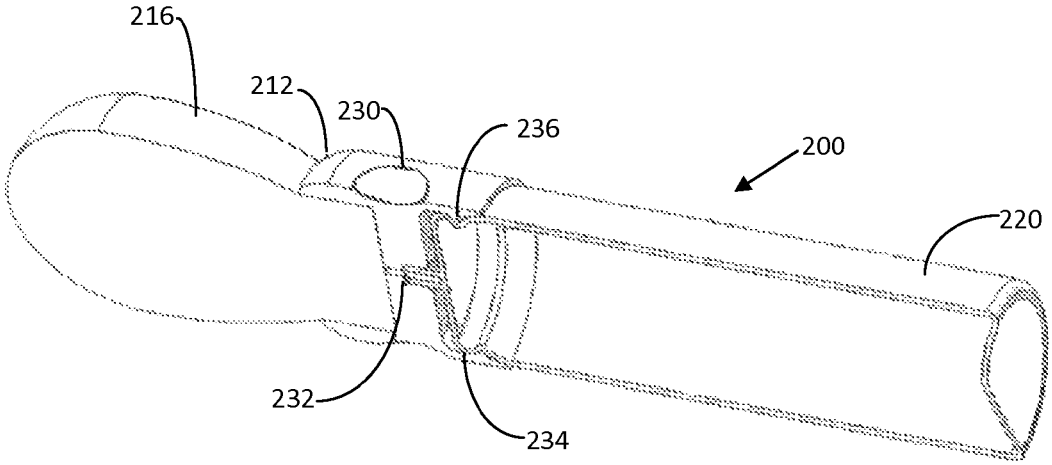
FIG. 13 is a cross-sectional view of the shaving brush of FIG. 9 in accordance with one embodiment of the present invention.

FIGS. 4-5 depict a device 100 consisting of a housing 110 with brush assembly 116 having at least one or more bristles at one end 112 of the housing 110 and a detachable bottom 118 at the other end 114 that can be removed to insert the non-pressurized cartridge, canister, or other replaceable element (cream for example) 120. In this embodiment, the non-pressurized cartridge 120 would dispense the cream using of a plate and screw type mechanism 124 with a knob 126 (best viewed in FIG. 5) that can be turned by hand forcing the cream up and out the base of the brush into the brush assembly 116 for application of the cream to a part of the body. Another embodiment of the device 150, similar to that of device 100, is illustrated in FIG. 8. In this embodiment, the mechanism that forces the shaving cream up and out the base of the bush may be a plunger type 128 that is pushed up, forcing the shaving cream up and out.

Figure 6:
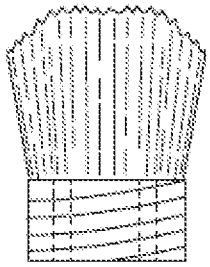
FIG. 6 is a view of the brush in accordance with one embodiment of the present invention.
Figure 7:
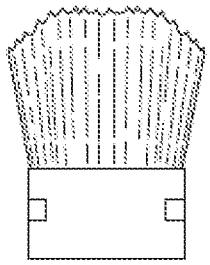
FIG. 7 is a view of the brush in accordance with another embodiment of the present invention.

FIGS. 6-7 illustrate that the device may consist of a brush assembly 116 that detaches from the cartridge or container for cleaning and sanitation and/or attachment to a new cartridge or container. The detachable brush assembly 116 may include a screw type that screws on and off the device, a lug type mechanism, detent or the like to fasten and unfasten it from the cartridge or canister (best viewed in FIG. 7). The non-pressurized cartridge would dispense the cream through the use of a plate and screw type mechanism with a knob that can be turned by hand forcing the cream up and out the base into the brush assembly for application of the cream to a part of the body.

FIGS. 9-13 depict a device 200 consisting of a housing 211 with brush assembly 216 having one or more bristles at one end 212 of the housing 211 and a detachable bottom 218 at the other or second end 214 that can be removed to insert the canister or cartridge 220 (best viewed in FIGS. 10-13) Mechanisms within the device 200 engage the pressurized can, cartridge or canister 220, dispensing the cream into the brush assembly for example. The dispensing mechanism may include a push button 230 located in or on the housing 211 engaging the canister or cartridge 220 or another such mechanism (best viewed in FIG. 10).

As illustrated in FIGS. 10-13, device 200 includes the pressurized can, cartridge or canister 220 extending between the first end 212 and second end 214. In the illustrated embodiment, the canister 220 includes a ring 234 extending circumferentially around the canister 220 and adapted to removably engage lip 236 in housing 211.

In the illustrated embodiment the canister 220 includes a needle, nozzle or elongated valve 232 connected to a housing 211 and in fluid communication with an interior or cavity in the canister 220. When the valve 232 is depressed, the contents of the canister 220 travels up the valve 232 and delivered into the brush assembly 216. The exterior of the canister 220 may be made of a non-corrosive material or coated to prevent corrosion. The exterior may also be composed of a material that allows for rapid heat transfer to the interior, allowing for rapid heating of the shaving cream.

Other embodiments relate to a method of shaving using any of the shaving brushes 10/100/200 provided previously. In at least one embodiment, the method comprises engaging the at least one engagement mechanism; and dispensing a cream into the plurality of bristles. The crème is spread over at least a portion of the user's or shavers face using the bristles. The user or shaver than shaves, using a razor.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

We claim:

1. A shaving brush comprising: a housing having opposing first and second ends;

a least one bristle located at the first end;

a cap located at the second end and removably connected to the housing;

a replaceable cosmetic element located in the housing in fluid communication with the at least one bristle;

a heating element located in the housing; and an engagement mechanism positioned on the cap and communicating with at least the replaceable element, whereby engaging the engagement mechanism engages the heating element, heating the replaceable cosmetic element prior to dispensing the replaceable cosmetic element into the at least one bristle.

2. The shaving brush of claim 1 wherein the replaceable cosmetic element comprises a solid or semi-solid element positioned within the housing.

3. The shaving brush of claim 1 wherein the replaceable cosmetic element comprises a liquid, foam or gel placed within the housing.

4. The shaving brush of claim 1 wherein the replaceable cosmetic element comprises a shaving can adapted to be received in the housing.

5. The shaving brush of claim 1 wherein the at least one bristle is adapted to be cleaned and sanitized.

6. The shaving brush of claim 1 wherein the at least one bristle is removeably connected to the first end of the housing.

7. A shaving brush comprising:

a housing having opposing first and second ends;

a plurality of bristles located at the first end;

a replaceable cap located at the second end;

a replaceable cosmetic element located in the housing communicating with the replaceable cap and in fluid communication with the plurality of bristles;

a heating element located in the housing; and an engagement mechanism positioned in the housing and flush therewith and communicating with at least the heating element and replaceable cosmetic element, whereby engaging the engagement mechanism engages the heating element heating the replaceable cosmetic element prior to dispensing the replaceable cosmetic element into the plurality of bristles.

8. The shaving brush of claim 7 wherein the engagement mechanism is positioned on at least one of the housing, in the housing or on the replaceable cap located at the second end of the housing.

9. The shaving brush of claim 7 wherein the replaceable cosmetic element comprises at least one of a solid element, a semi-solid element, a liquid, foam, a gel, a shaving can, and some combination thereof adapted to be received in the housing.

10. The shaving brush of claim 7 wherein the plurality of bristles are adapted to be cleaned and sanitized.

11. The shaving brush of claim 7 wherein the plurality of bristles are removeably connected to the first end of the housing.

12. A method of shaving using a shaving brush, comprising:

the shaving brush comprising:

a housing with opposing first and second ends;

a plurality of bristles located at the first end;

a replaceable cap located at the second end; at least one engagement mechanism located on at least one of the housing, in the housing and the replaceable cap;

a replaceable element containing a cream located in the housing communicating with the at least one engagement mechanism and in fluid communication with the plurality of bristles; and a heating element located in the housing;

the method comprising:

engaging the at least one engagement mechanism;

heating the cream in the replaceable element prior to dispensing;

dispensing the cream into the plurality of bristles;

spreading the cream over at least a portion of a user's face; and shaving using a razor.

* * * * *